US006125322A

United States Patent [19]

Bischof et al.

[11] Patent Number: 6,125,322

[45] Date of Patent: Sep. 26, 2000

[54] METHOD AND DEVICE FOR CONTROLLING A VEHICLE DRIVE UNIT

[75] Inventors: Hubert Bischof; Martin Streib, both of Vaihingen, Germany

[73] Assignee: Robert Bosch GmbH, Stuttgart, Germany

[21] Appl. No.: 08/952,091

[22] PCT Filed: Oct. 2, 1996

[86] PCT No.: PCT/DE96/01898

§ 371 Date: Nov. 10, 1997

§ 102(e) Date: Nov. 10, 1997

[87] PCT Pub. No.: WO97/33083

PCT Pub. Date: Sep. 12, 1997

[30] Foreign Application Priority Data

Mar. 9, 1996 [DE] Germany ..... 196 09 242

[51] Int. Cl.[7] ..... F02D 41/22

[52] U.S. Cl. ..... 701/114; 123/350; 123/397

[58] Field of Search ..... 701/107, 110, 701/114, 31; 123/350, 396, 399, 339.15, 397

[56] References Cited

FOREIGN PATENT DOCUMENTS

| | | |
|---|---|---|
| 0121937 | 10/1984 | European Pat. Off. . |
| 0512240 | 11/1992 | European Pat. Off. . |
| 3728561 | 3/1989 | Germany . |
| 4237198 | 5/1994 | Germany . |
| 4438714 | 5/1996 | Germany . |

*Primary Examiner*—Andrew M. Dolinar
*Attorney, Agent, or Firm*—Walter Ottesen

[57] ABSTRACT

A method and an arrangement for controlling a drive unit of a vehicle are suggested. In this method, the control functions for the power of the drive unit and the monitoring of these control functions are carried out by a single microcomputer. A monitoring module, which is separate from the microcomputer, is provided for checking the monitoring functions. The monitoring module transmits test signals to the microcomputer at a given time. The microcomputer then computes the monitoring function on the basis of test data. The result of the computation is transmitted to the monitoring module which checks the operability of the monitoring function in the microcomputer by making a comparison to stored values.

11 Claims, 7 Drawing Sheets

METHOD AND DEVICE FOR CONTROLLING A VEHICLE DRIVE UNIT

FIELD OF THE INVENTION

The invention relates to a method and an arrangement for controlling a drive unit of a vehicle.

BACKGROUND OF THE INVENTION

A method and an arrangement of this kind are disclosed in U.S. patent application Ser. No. 08/836,018, filed Apr. 29, 1997, now U.S. Pat. No. 5,880,568. There, a control unit is provided which includes a microcomputer. The microcomputer carries out the control of the power of the drive unit (in the case of an internal combustion engine, via air supply, fuel metering and/or ignition angle) as well as the monitoring of the correct function of these control programs. The program structure of this microcomputer includes essentially three mutually separated levels (compare also the description with respect to FIG. 1). In a first level, the control functions are computed. In a second level, the correct operation of the control functions of the first level is checked based on selected input and output signals. In a third level, a check of the monitoring carried out in the second level is realized in the context of a sequence control. This sequence control checks the correct processing of the monitoring steps in cooperative relationship with a monitoring module (watchdog or safety computer). For this purpose, the monitoring module poses a question, which is selected from predetermined questions. This question is answered by the second level by forming a part answer of the programs. The second level sends the question back to the monitoring module for detecting faults. In the preferred embodiment, the second level monitors the air adjustment of the engine and, in the case of a fault, switches this air adjustment off or initiates an emergency operation. In this embodiment, the monitoring module intervenes in the output stage for the actuator, which controls the air supply, as well as in the output stages for the metering of fuel and in the ignition. Measures for monitoring the computations, which are carried out in the context of the function monitoring in the second level, in addition to the control of the program sequence are not described in this known solution.

It is an object of the invention to provide measures for checking the computations in the context of the function monitoring.

SUMMARY OF THE INVENTION

The solution according to the invention permits the detection of faults of the microcomputer which operates in the same manner on the computation of the control functions as well as on the computation of the monitoring functions. For this reason, and in an advantageous manner, also quiescent faults are detected, for example, a monitoring function which does not compute correctly quantitatively.

Here, it is especially advantageous that operations are not used in the context of the solution of the invention which would be present separately from the programs to be monitored; instead, the program codes to be monitored are used. In this way, the solution according to the invention permits an almost one-hundred percent check of the function monitoring of a control for a drive unit.

It is especially advantageous that representative tests can be carried out for a suitable selection of sets of test data in all relevant value ranges. In this way, a bit-precise check of a monitoring function of a power control of a drive unit is provided.

BRIEF DESCRIPTION OF THE DRAWINGS

The invention will be explained in greater detail with respect to the embodiments shown in the drawing. Here.

DESCRIPTION OF THE PREFERRED EMBODIMENTS OF THE INVENTION

Figure 1:
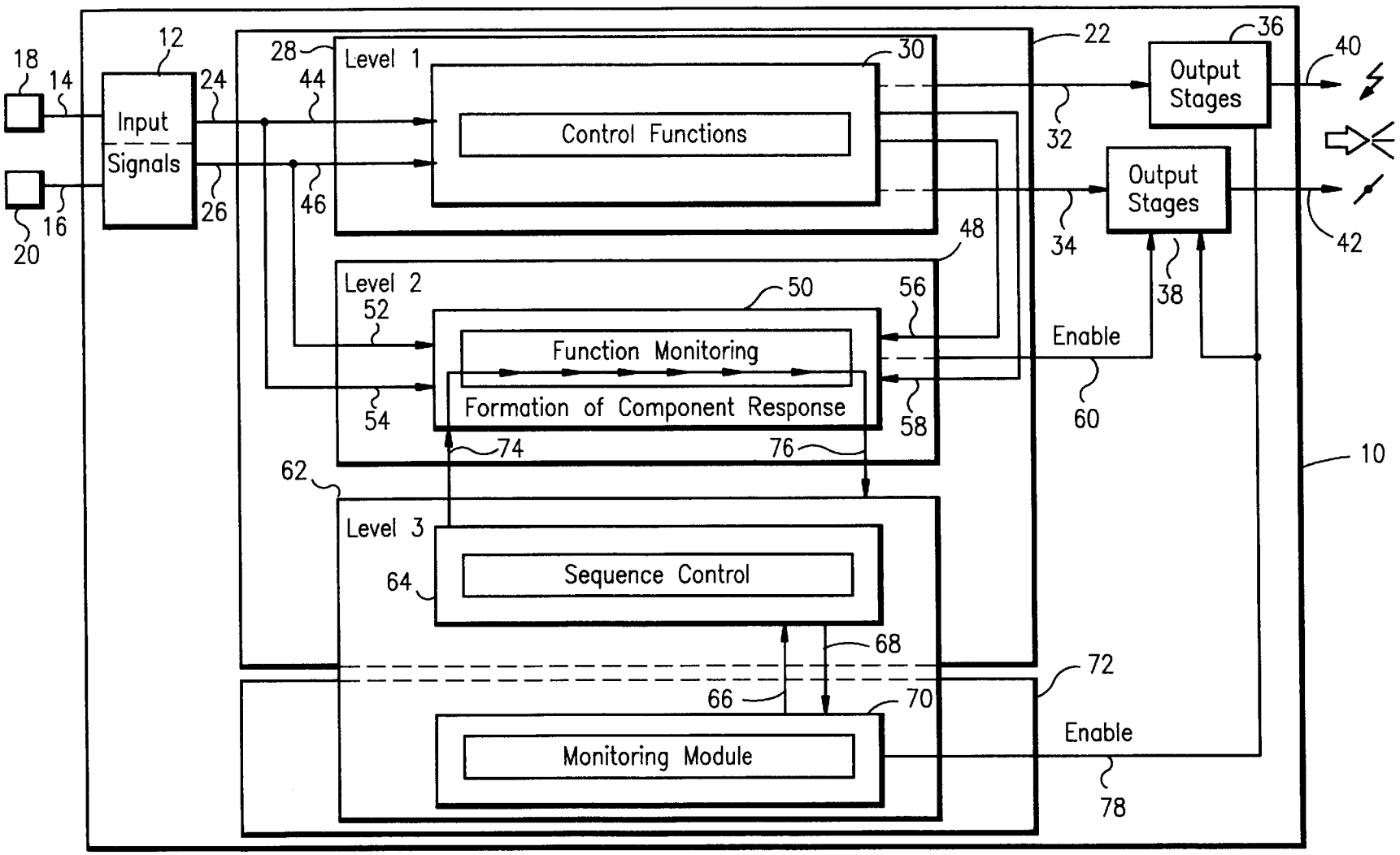
FIG. 1 shows a structural diagram of a control arrangement for a drive unit; whereas, in FIGS. 2 and 3, a first embodiment of the solution of the invention is shown with reference to flowcharts.

In FIG. 1, a control unit 10 is shown for the control of a drive unit (preferably an internal combustion engine) of a motor vehicle. The control unit 10 includes, inter alia, an input circuit 12 to which input lines 14 and 16 are connected from measuring devices 18 and 20. In the input circuit 12, the input signals of the control unit are processed and supplied to a microcomputer 22. In the preferred embodiment of a power control, the measuring devices 18 and 20 are two measuring devices for detecting the degree of actuation of an operator-controlled element actuated by the driver, for example, an accelerator pedal. The two measuring devices can be configured so as to be redundant or, in another embodiment, as a continuous measuring device (for example, a potentiometer) and a discontinuous measuring device (for example, a switch). The measuring signals of the measuring devices are supplied via the lines 14 and 16 to the input circuit 12 and are there processed separately from each other and, preferably, are supplied to the microcomputer 22 via separate paths 24 and 26, for example, via two input ports or two A/D-channels. In addition to these measuring signals, additional measurement variables of the drive unit and/or the vehicle are supplied to the control unit or to the microcomputer. These measurement variables are, for example, engine rpm, position of the power adjusting element, et cetera which is not shown in FIG. 1 for reasons of clarity. The microcomputer 22 is, with respect to its program structure, essentially subdivided into three levels. In a first level 28, the programs 30 for carrying out the control of the drive unit are combined. In the preferred embodiment, the programs are those which adjust the torque of the drive unit on the basis of the degree of actuation of the operator-controlled element (supplied via lines 44 and 46) and additional operating variables. In the preferred embodiment of an internal combustion engine, the air supply via an electrically actuable throttle flap is adjusted and the fuel metering and the ignition time point are computed. Correspondingly, the computer 22 has output lines 32 and 34 which lead to output stages 36 and 38 which, in turn, adjust, via corresponding output lines 40 and 42, the ignition time point, fuel metering and air supply. In a second level 48, the programs 50 are combined which serve to monitor functions of the control functions 30. Here, in a preferred embodiment, a permissible torque of the drive unit which is derived from the driver command is compared to the adjusted torque and, when this torque is exceeded, a fault condition is detected. In the preferred embodiment of the control of an internal combustion engine, plausibility checks of the degree of actuation of the operator-controlled element can be carried out and of the adjustment of the throttle flap or corresponding values for the engine load. Accordingly, and on the one hand, the input signals with respect to the degree of actuation of the operator-controlled element are supplied to level 2 (there the programs 50 for function monitoring) (connecting lines 52 and 54) and, on the other hand, computation results of programs 30 for the control functions (connections 56 and 58) are supplied to level 2. In another embodiment, additionally, or alternatively to the computation results, measurement variables for the engine load, the throttle flap position and/or the torque are supplied. The function monitoring 50 in a preferred embodiment exercises influence on the output stage 38 for controlling the throttle flap via the output line 60 of the microcomputer 22. In addition to the first and second levels, the program structure of the microcomputer 22 has a third level 62 in which the programs 64 for the sequence control of the function monitoring 50 are combined. The programs 64 then communicate via connecting lines 66 and 68 to a monitoring module 70 of a watchdog or safety computer 72 which is separate from the microcomputer. For sequence control, the monitoring module 70 selects predetermined sequences in the programs 64 via the connecting line 66. These sequences comprise essentially that the sequence control 64 triggers in the function monitoring 50 the execution of a computation (response) on the basis of component responses which are formed in accordance with selected program steps (via line 74). The result of this computation is again supplied to the sequence control 64 (via connection 76). The result or a variable derived therefrom is supplied by the sequence control 64 via the connection 68 to the monitoring module 70 which compares the response to its question outputted via line 66. In the case of a fault, the monitoring module 70 exercises influence via the output line 68 on the output stages 36 and 38.

In the preferred embodiment, a desired value for the torque of the drive unit is derived from the degree of actuation of the operator-controlled element. The actual torque is caused to approach this desired value by adjusting the air supply, the fuel metering and the ignition angle.

According to the invention, and for expanded monitoring of the function of the microcomputer, and at least in the critical case of the released operator-controlled element (idle), the following is provided in a first embodiment: the monitoring module 70 outputs cyclically (for example, every 200 msec) at least in predetermined operating states a stimulus information via the serial interface or a port pin to the microcomputer 22 when, for example, the operator-controlled element is released, when maintained at steady state, the degree of actuation is within a pregiven value range and/or after the elapse of a predetermined operating duration or number of operating cycles. The microcomputer 22 reacts to this stimulus signal in that it, at least for parts of the monitoring function (preferably for the actual torque computation or for the computation of the permissible torque) does not take the variables, which are stored in the memory cell, as a basis for the monitoring function but rather test signals which hurt the monitoring function in the corresponding operating state (for example, which cause a high actual torque or a low permissible torque). These variables are, for example, actual torque forming variables such as the load signal and adjusted ignition angle or the degree of actuation. When the programs of the level 2 operate correctly, a fault must be detected in this case. The fault counter, which is available in the level 2, is accordingly incremented. For a certain count of the fault counter, the monitoring module expects a specific reaction of the microcomputer 22, for example, the transmission of a fault signal or a reset signal. If the monitoring module 70 receives a signal of this kind, then the stimulus signal is withdrawn and a functionally operable second level is recognized. If the corresponding signal is not recognized within a pregiven time span (increment time of the counter), then either one of the programs of level 2 has a fault or a function is active in which the driver does not actuate the pedal (for example, road-speed controller, drag torque controller) and this function increases the engine torque beyond the command of the driver (at least then when the actual torque is influenced by the test signal). To check this, the monitoring module 70 maintains the stimulus signal. In the context of its function monitoring, the microcomputer 22 now computes the torque monitoring on the basis of the driver command (idle) and not as for the increased intervention provided with other permissible torques. In this case, the fault counter must in any event be incremented so that the corresponding reaction signal of the microcomputer 22 is triggered. If such a signal is not received by the monitoring module 70, then a fault is detected in the area of function monitoring and the corresponding switch-off or emergency measures are initiated via the output line 78.

Figure 2:
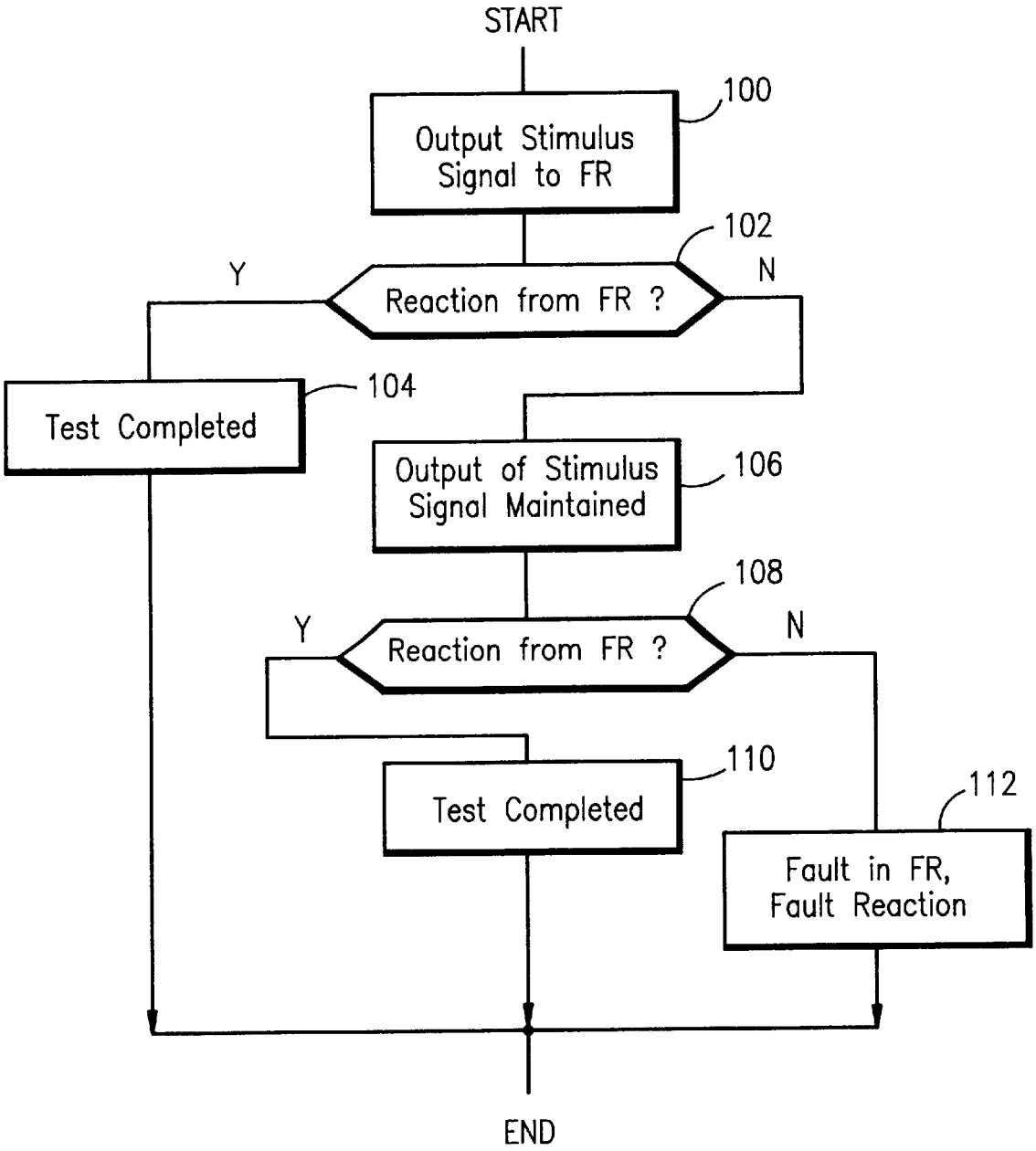
Figure 3:
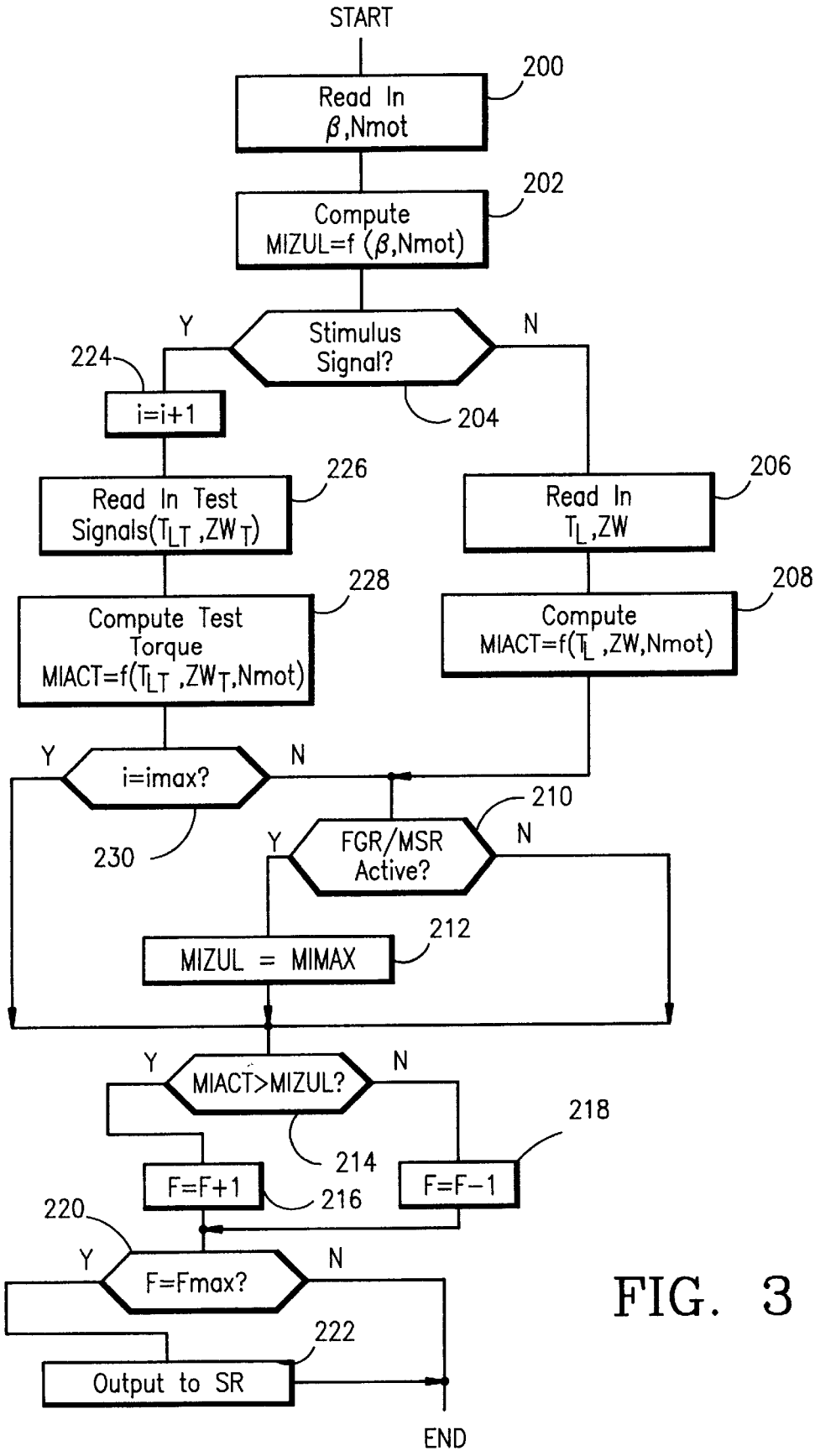

A first embodiment of the solution of the invention is shown in FIGS. 2 and 3 with respect to flowcharts. These sketch the realization of the solution as programs in the monitoring module and in the function monitoring.

The flowchart shown in FIG. 2 defines a program of the monitoring module 70. This program is carried out in pregiven time intervals (for example, every 200 msec) when one of the above-mentioned operating states is present. In the first step 100, the stimulus signal is outputted to the microcomputer 22 (FR=function computer). The stimulus signal is then, for example, realized with a level change, via a signal having a pregiven pulse-duty factor or a pregiven voltage magnitude on an input line of the microcomputer 22. In the next step 102, a check is made as to whether, after a lapse of a predetermined time span, during which the fault counter has reliably reached its maximum value, the corresponding reaction signal from the microcomputer 22 has been detected. If this is the case, then, according to step 104, the test is viewed as being completed and the subprogram is ended. The subprogram is again initiated with the presence of the next pregiven operating situation.

In another advantageous embodiment, and in lieu of the reaction signal of the microcomputer 22, the actual fault counter position is transmitted to the monitoring module 70. The monitoring module 70 detects the correct function or a faulty operation of the microcomputer 22 based on the time-dependent trace of the fault counter or when a limit value is exceeded.

If the monitoring module does not detect the operation of the microcomputer to be expected based on the stimulus signal in step 102, then, in accordance with step 106, the output of the stimulus signal is maintained. Thereupon, in accordance with step 108, a check is made again as to whether the reaction from the microcomputer 22 or the expected performance of the fault counter of the microcomputer 22 is present. If this is the case, then, in accordance with step 110, the test is viewed as completed and the program is ended; whereas, in the opposite case, and in accordance with step 112, it is assumed that a fault is present in the area of the function monitoring of the microcomputer 22 and corresponding fault reactions are initiated by the monitoring module. These include essentially a switchoff of the output stages for metering fuel, the ignition angle and the air supply or, an emergency operation, which has as a consequence a limited (especially a power limited) control of the drive unit. The program is ended after step 112.

In FIG. 3, the corresponding program of level 2 (the function monitoring of the microcomputer 22) is shown.

This is initiated in pregiven time intervals (for example, every several milliseconds). After start of the subprogram, and in a first step 200, the degree of actuation of the operator-controlled element β as well as the engine rpm $N_{mot}$ are read in and, in accordance with step 202, a permissible torque MIZUL is determined on the basis of a pregiven characteristic field, a pregiven table or pregiven computation steps from the degree of actuation β and the engine rpm $N_{mot}$. This permissible torque is then dimensioned in such a manner that it is not exceeded by the actual torque of the drive unit during fault-free operation of the microcomputer while considering all tolerances. Thereafter, in step 204, a check is made whether a stimulus signal from the monitoring module is present. If this is not the case, then function monitoring is initiated with steps 206 and 208. For this purpose, the load signal TL (for example, formed from air mass and engine rpm) and the adjusted ignition angle ZW are read in (step 206) and, on the basis of these two variables, as well as the engine rpm and in accordance with a predetermined characteristic field, a predetermined table or predetermined computation steps, the torque $MI_{act}$ outputted by the engine is determined. In the next inquiry step 210, a check is made as to whether just then an intervention is active, for example, via a road-speed controller (FGR) or an engine drag torque controller (MSR) with this intervention being an intervention increasing torque compared to the desired torque pregiven by the operator. If this is the case, then, and according to step 212, the permissible torque MIZUL is set to a maximum value $MI_{max}$ which, for example, is dependent upon rpm or dependent upon speed. The maximum value $MI_{max}$ is predetermined for these operating states. After step 212, a comparison is made between the actual torque $MI_{act}$ and permissible torque MIZUL. This is the same as in the case after a "no" answer in step 210. If the computed actual torque is greater than the computed permissible torque, then, according to step 216, the fault counter F is incremented; in the opposite case, according to step 218, the fault counter F is decremented. In the next inquiry step 220, a check is made as to whether the fault counter has reached its maximum value. If this is the case, then, according to step 222, a corresponding signal is outputted to the monitoring module 70 (safety computer SR) and the program is ended in step 220 as in the case of a "no" answer.

If, in step 204, it results that a stimulus signal is present, then a counter i is incremented in accordance with step 224. The counter i runs in this part of the program. Thereupon, in step 226, selected test signals are pregiven for the engine load TLT and the ignition angle ZWT and, according to step 228 (corresponding to step 208), an actual torque is specified. In the next inquiry step 230, the counter i is compared to a maximum value $i_{max}$. If this maximum value is not reached, then the program continues with step 210; otherwise, a jump is made directly into step 214. The counter i then assures that, for a stimulus signal which continues to be present and an active road-speed controller or an active drag torque controller, the desired test situation is generated. The maximum value $i_{max}$ is then dimensioned with a view to the time span which the fault counter requires in order to reach its maximum value (for example, two to three program runthroughs). If the actual torque exceeds the permissible torque and the fault counter runs up properly, then, according to step 222, the reaction signal is outputted to the monitoring module for a correct operating monitoring function.

In another advantageous embodiment, the count of the fault counter is transmitted at least for a test situation.

In FIG. 4, the solution of the invention is shown with respect to time diagrams. FIG. 4*a* shows the time-dependent trace of the stimulus signal and FIG. 4*b* shows the time-dependent traces of the actual torque and the permissible torque. FIG. 4*c* shows the time-dependent trace of the fault counter and FIG. 4*d* shows the intervention of a road-speed controller or drag torque controller. FIG. 4*e* shows the time-dependent trace of the feedback signal of the microcomputer 22 to the monitoring module 70.

Figure 4A:
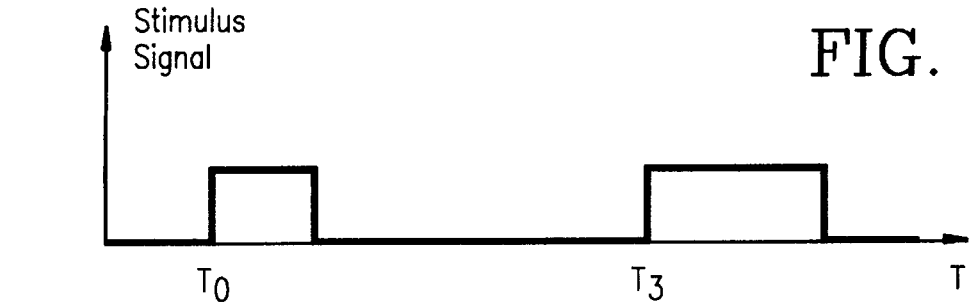
FIGS. 4*a*–4*e* shows signal traces for this embodiment.
Figure 4B:
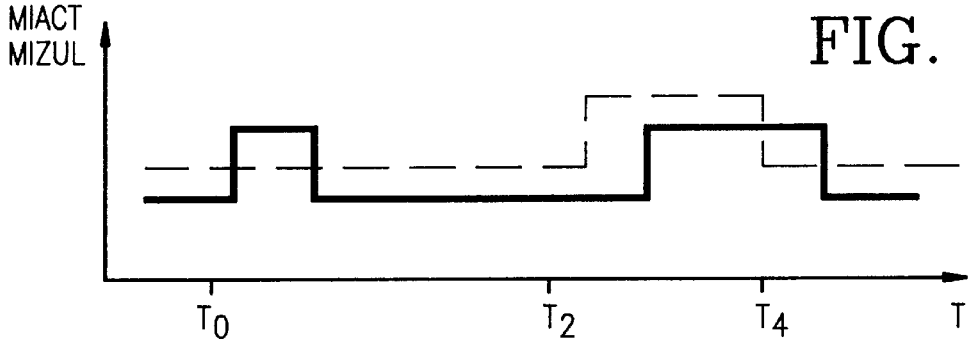
Figure 4C:
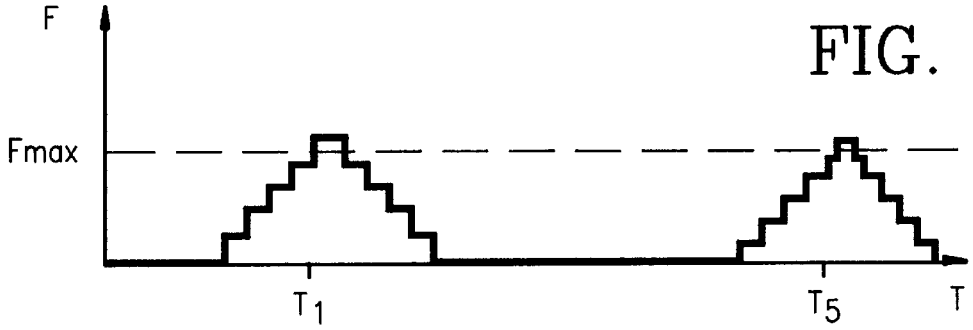

At a first time point T0, the microcomputer 22 receives the stimulus signal outputted by the monitoring module (see FIG. 4*a*). The actual torque (FIG. 4*b*, solid line) is then determined in accordance with test data and, directly thereafter, exceeds the permissible torque which is computed on the basis of the degree of actuation (FIG. 4*b*, broken line). Correspondingly, the fault counter increments up until, at time point T1, the maximum fault count $F_{max}$ is reached (see FIG. 4*c*). This leads in correspondence to FIG. 4*e* to the output of a corresponding fault signal to the monitoring module, to a resetting of the stimulus signal and to an end of the test situation (see FIGS. 4*a,* 4*b*). In this example, the monitoring operated correctly. The fault counter is again decremented after the time point T1.

Figure 4D:
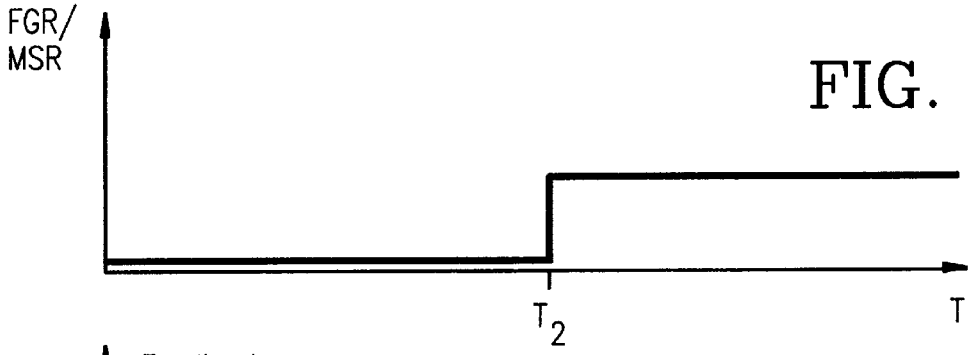
Figure 4E:
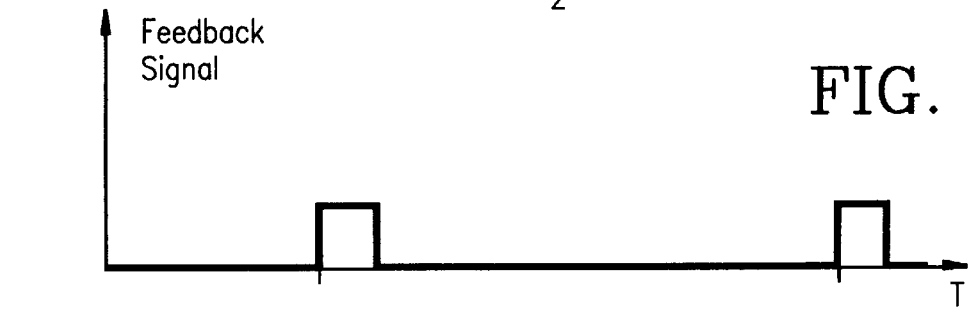

A road-speed controller is activated at a later time point T2 (FIG. 4*d*). In this operating situation, the permissible torque is increased (see FIG. 4*b*). At time point T3, the monitoring module outputs a stimulus signal to the microcomputer 22. This signal leads, in correspondence to FIG. 4*b*, to the computation of the actual torque in accordance with test data. In this case, the actual torque, in accordance with test data, does not exceed the permissible torque. This means that, at time point T4, the stimulus signal is maintained and the permissible torque is so determined as if the road-speed controller were not engaged. For this reason, and for a functioning monitoring, the actual torque exceeds the permissible torque (see FIG. 4*b*) as in the previous situation so that, starting at time point T4 until time point T5, the fault counter is incremented. Reaching the maximum count of the fault counter leads, at time point T5, to the output of the fault signal to the monitoring module so that, here too, the correct operation of the monitoring is shown. Starting at time point T5, the fault counter is again decremented in accordance with FIG. 4*c*.

Figure 5:
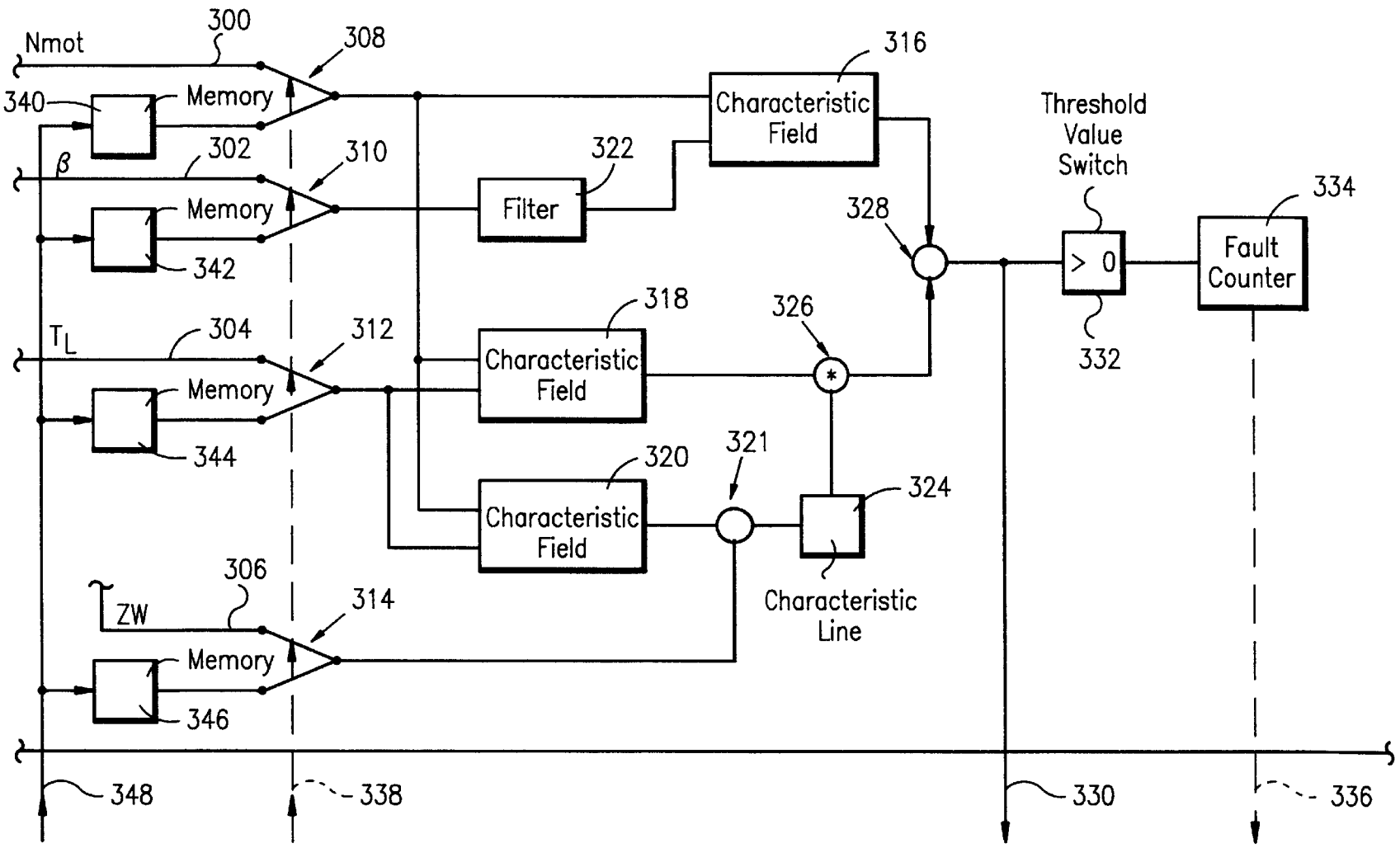
In FIGS. 5, 6 and 7, a second embodiment of the solution according to the invention is shown as a block circuit diagram or as flowcharts.
Figure 6:
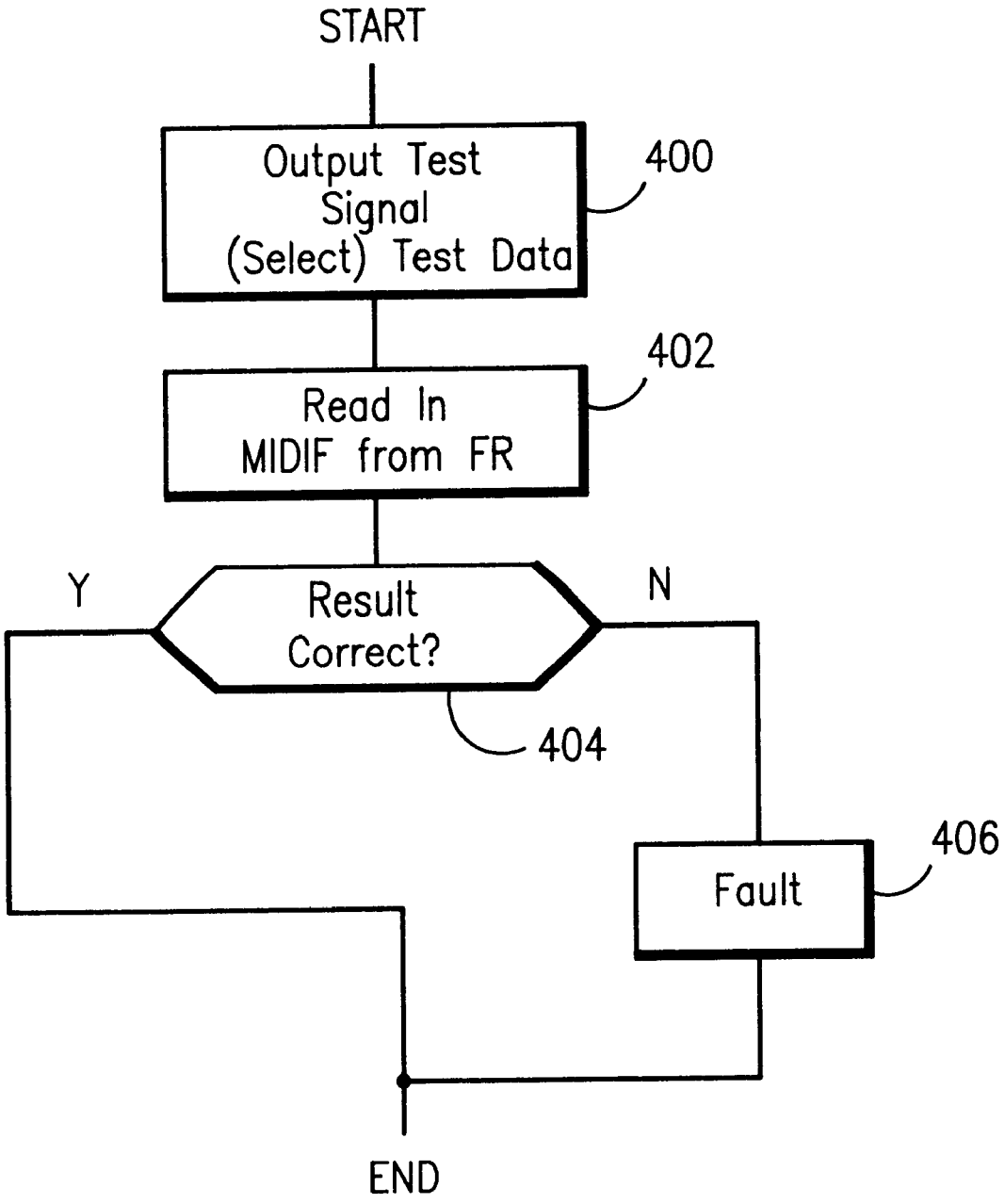
Figure 7:
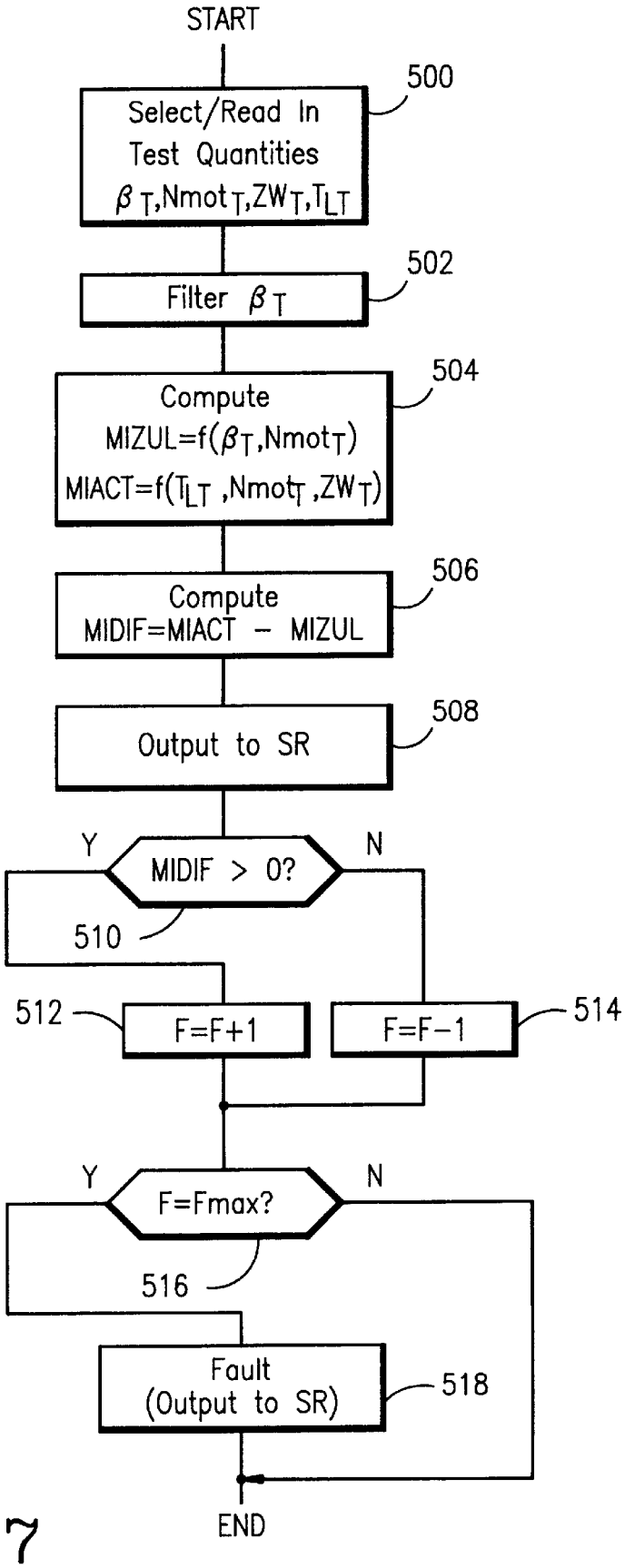

A second embodiment of the solution of the invention is shown with respect to FIGS. 5 to 7. This embodiment too serves to check whether the monitoring tasks of a microcomputer are executed properly and reliably and is utilized especially for control systems wherein the control functions and the monitoring functions are implemented by the same microcomputer. With the transfer of the fault counter or of a signal derived therefrom in accordance with the first embodiment, a direct check of the monitoring function is obtained although a precise bit check of the monitoring function does not take place. Instead, a type of threshold monitoring is carried out. To provide a precise bit check of the computations in the context of the monitoring of level 2, the monitoring function of level 2 is therefore, in accordance with the second embodiment, at least in predetermined operating situations, alternately computed with real data and with test data. Preferably, for the computation with test data, the original program of level 2 is used with changed data. A copy of the program is used in another advantageous embodiment.

For the computation of the monitoring with real data, a permissible engine torque is determined from the actual values of pedal position and engine rpm and an actual torque is determined from the values for the air charge, rpm and ignition angle. An incorrectness with respect to plausibility is checked via a difference formation. In a case of an incorrectness, preferably in the case of an actual torque, which is too great in comparison to the permissible engine torque, a fault counter is started. After this computation, the monitoring module outputs a test signal whereupon this computation is not made with real data but with test data (for engine rpm, pedal position, air charge and ignition angle). These test data are either stored in the monitoring module and are transmitted via an interface to the microcomputer 22 or are stored in the microcomputer 22 as different sets of test data which the monitoring module selects via a transmitted index. For a fixed set of test data, there is only a single correct solution for the difference between permissible torque and actual torque. This correct solution, which belongs to each set of test data, is known to the monitoring module. The microcomputer 22 transmits this difference to the monitoring module which checks the correctness of the result. The sets of test data are so selected that plausible results as well as implausible results are determined. For this reason, a check can also be made as to whether the monitoring level is still in the position to differentiate plausible states from implausible states.

This second embodiment is shown as a block circuit diagram in FIG. 5. This block diagram symbolizes the program structure in level 2 of the microcomputer 22. The engine rpm $N_{mot}$, the accelerator pedal position β, the air charge TL and the adjusted ignition angle ZW are supplied to the monitoring function via the respective connections 300, 302, 304 and 306. These signals are transmitted further via respective switching elements 308, 310, 312 and 314. The engine rpm is conducted to the following: a first characteristic field 316 to determine the permissible engine torque; to a second characteristic field 318 to determine the optimal engine torque; and, to a characteristic field 320 to determine the optimal ignition angle. The pedal position β is conducted via a filter 322 to the first characteristic field 316. The air charge is conducted to the second characteristic field 318 and to the third characteristic field 320. The optimal ignition angle is determined in the characteristic field 320 (highest efficiency for the internal combustion engine). This ignition angle is conducted to an addition stage 321 wherein the difference between the optimal ignition angle and the actual ignition angle is formed. This difference is conducted via a characteristic line 324 to a multiplier position 326. The characteristic line 324 converts the deviation of the ignition angle into a deviation of the actual torque from the optimal torque (highest efficiency). In the multiplier position 326, the optimal engine torque is corrected via an ignition angle deviation in accordance with the torque correction. The result is a measure for the actual torque. This actual torque is conducted to the adding position 328 to which the permissible torque is also conducted from characteristic field 316. By subtracting the permissible torque from the actual torque, the torque difference is formed which is conducted via the connecting line 330 to the monitoring module. Furthermore, the torque difference is conducted to a threshold value switch 337 which increments the fault counter 334 in the event that the actual torque exceeds the permissible torque. In the preferred embodiment, the count of the fault counter is transmitted to the monitoring module via connection 336 at least when the fault counter reaches its maximum value. A connection 338 is provided from the monitoring module which switches the switching elements 308 to 314 from the normal position into the test position shown in phantom outline. In this position, the connections for engine rpm, pedal position, air charge and ignition angle are connected with tables or memories 340, 342, 344 and 346 which contain different sets of test data. These sets of test data are selected in dependence upon the selection signal supplied from the monitoring module via connection 348.

Examples for realizing the solution of the invention are presented in the context of the second embodiment as computer programs and are shown as flowcharts in FIGS. 6 and 7. FIG. 6 shows the program which is run through in the monitoring module; whereas, FIG. 7 describes a program which is run through in the microcomputer 22.

The program of the monitoring module shown in FIG. 6 is called up at pregiven time intervals. In an advantageous embodiment, the subprogram is called up only in at least one of the above-mentioned specific operating situations. In the first step 400 of the subprogram shown, the test signal is formed and outputted to the microcomputer 22 and a set of test data or an index fixing a set of test data is transmitted. The test data are read out in the preferred embodiment with respect to the actual operating state (defined by accelerator pedal position and engine rpm or air charge) and are alternately selected as plausible combination or implausible combination. In the context of the realization of the solution of the invention, also other strategies are utilized (for example, only plausible data, only implausible data) with respect to starting the test and the selection and input of the test data. In the next step 402, the torque difference $MI_{Diff}$, which is computed by the microcomputer 22, as well as the count of the fault counter, if required, are read in and, in step 404, a check is made on the basis of stored difference values as to whether the computed result is correct. If the result is correct, the program is started anew with other test data. If the result does not match, then, in accordance with step 406, a fault state is detected and the subprogram is ended. Depending upon the selected strategy, the corresponding reactions (switchoff of the output stages) can be carried out after a one-time detection of a fault or only for a multiple detection of faults. In other advantageous embodiments, a fault counter runs in the monitoring module and, when the maximum value of the fault counter is reached, fault measures are initiated. When the count of the fault counter is transmitted, the monitoring module checks the time-dependent trace of the count of the fault counter and/or if the maximum value is reached.

The subprogram shown in FIG. 7 shows a program which is started in the microcomputer 22 at pregiven time intervals. After the start of the program, and in a first step 500, the test variables for the pedal position, the engine rpm, the ignition angle and the air charge are selected and read in when a test signal is present. If no test signal is present, then the measured or computed actual variables are read in. In the following, a situation is described wherein a test signal is present. In normal operation, the program is run through correspondingly except that in lieu of the test data, the actual values of the operating variables are used. In step 502, the signal value for the pedal position is subjected to a pregiven filtering. Thereupon, and in accordance with step 504, the permissible torque MIZUL is determined on the basis of the test values for pedal position and engine rpm and the actual torque $MI_{act}$ is determined on the basis of test quantities for the air charge, ignition angle and engine rpm. In the next step 506, the difference torque $MI_{Diff}$ is formed as the difference of the actual torque and of the permissible torque and, in accordance with step 508, this difference torque $MI_{Diff}$ is outputted to the monitoring module. In the next step 510, a check is made as to whether the difference torque is greater than 0. If this is the case, then the fault counter 512 is incremented by 1; otherwise, the fault counter 512 is decremented (step 514). Thereupon, and in step 516, a check is made as to whether the fault counter has reached its maximum value. For a positive answer, and in accordance with step 518, a fault is detected and, if required, a corresponding signal is outputted to the monitoring module. If the fault counter has not yet reached its maximum value, the program is ended and restarted at a pregiven time. Alternatively, the actual count of the fault counter is transmitted.

A combination of the first and second embodiments is especially advantageous. Here, the difference between the torque quantities as well as the fault counter are transmitted from the microcomputer 22 to the monitoring module. The monitoring module monitors on the basis of these values the bit-precise computation of the torque difference as well as the operation of the fault determination (especially the differentiation between plausible and implausible deviations of the permissible torque from the computed torque).

The control function for the torque adjustment runs, notwithstanding the test phases for the function monitoring, always on the basis of the actual values so that the operation of the drive unit is not affected by the test.

The solution of the invention is utilized in the same manner also for diesel engines while considering the corresponding operating variables.

The monitoring function is described in the preferred embodiment on the basis of the indicated torque, that is, on the basis of the torque generated by combustion. In other embodiments, the monitoring and therefore also the test is performed on the basis of another torque value (for example, the outputted torque), a charge value or load value, a power value or pedal position and throttle flap position. The solution of the invention is carried out in a corresponding manner with the input of the sets of test data.

In addition to the computation of the permissible torque on the basis of the accelerator pedal position, the adjustment of other operator-controlled elements is also taken into consideration in corresponding operating states (for example, a road-speed controller), desired values of external interventions which input a desired torque value (for example, road-speed controller, engine drag torque controller, drive slip controller, et cetera) and/or special operating variables (for example, road speed, slip, rpm, et cetera) in these operating states for the determination of permissible torque and, in this way, the monitoring and their check is ensured even in this or in other operating states.

If the solution of the invention is utilized for diesel engines, then, in lieu of the charge, fuel quantity and in lieu of the ignition, the injection start is read.

In addition to transmitting the difference between permissible and actual torque and/or the count of the fault counter, other intermediate quantities are transmitted in other embodiments, such as the permissible torque and the actual torque, an evaluated difference when exceeding threshold values, et cetera.

We claim:

1. A method for controlling a drive unit of a vehicle, the method comprising the steps of:

providing a microcomputer for controlling the power of the drive unit via first programs in dependence upon operating variables of the drive unit and of the vehicle and for monitoring this power control via second programs on the basis of selected operating variables in accordance with a monitoring function;

providing a monitoring module for issuing a test signal to permit said microcomputer to monitor the operability of said monitoring function;

utilizing said microcomputer to compute said monitoring function in accordance with said test signal on the basis of selected test data with said microcomputer determining at least one result of said monitoring function; and, transmitting said at least one result to said monitoring module for checking the accuracy thereof.

2. The method of claim 1, wherein the monitoring module checks the operability of the monitoring function in the microcomputer by comparing the transmitted result to an expected value.

3. The method of claim 2, wherein the monitoring function is executed on the basis of a permissible torque and a computed actual torque, the permissible torque being computed in dependence upon the position of operator-controlled elements or external inputs.

4. The method of claim 3, wherein the drive unit is an internal combustion engine which receives an air charge and has an ignition angle which can be adjusted; and, the permissible torque is computed on the basis of engine rpm, accelerator pedal position and the adjustment of other operator-controlled elements or external inputs; and, the actual torque is computed on the basis of the air charge at least one of the following: fuel quantity, the engine rpm and the adjusted ignition angle and injection start.

5. The method of claim 4, wherein: in order to check the monitoring function, a permissible torque and an actual torque are determined on the basis of test data and compared to each other.

6. The method of claim 5, wherein: to check the monitoring function in response to a test signal, an actual torque is determined on the basis of test signals and is compared to the permissible torque determined on the basis of measured values.

7. The method of claim 6, wherein the difference between actual torque and permissible torque is transmitted to the monitoring module which checks the correctness of the computation of the difference in the microcomputer on the basis of stored measured quantities assigned to the test data.

8. The method of claim 7, wherein: when the actual torque exceeds the permissible torque, a fault counter is incremented and the count of this counter or the count thereof in excess of a maximum count of the counter is outputted to the monitoring module, which determines the operability of the monitoring on the basis of the transmitted signal.

9. The method of claim 8, wherein: for an intervention which can increase the torque beyond the driver command, the maximum permissible torque is set to a higher value independent of the driver command; the monitoring module, for a non-detected reaction of the microcomputer to incorrect test data, causes the microcomputer to apply the permissible torque, which is derived from the pedal, even in this operating state for checking the monitoring.

10. The method of claim 9, wherein: said drive unit is provided with an output stage for adjusting the air supplied to said drive unit and is provided with an output stage for metering fuel thereto; and, wherein for a case of a fault detected by the monitoring function, the output stages for the adjustment of air and/or the output stages for the metering of fuel are disabled by the monitoring module.

11. An arrangement for controlling a drive unit of a vehicle, the arrangement comprising:

a microcomputer for controlling the power of the drive unit via first programs in dependence upon operating variables of the drive unit and of the vehicle and monitoring execution of said first programs via second programs on the basis of selected operating variables;

a monitoring module for issuing a test signal to permit said microcomputer to monitor the operability of said monitoring function;

said microcomputer being programmed to compute said monitoring function in accordance with said test signal on the basis of selected test data with said microcomputer determining at least one result of said monitoring function; and, means for transmitting said at least one result to said monitoring module for checking the accuracy thereof.

* * * * *